US006245711B1

(12) United States Patent
Halbrook, Jr.

(10) Patent No.: US 6,245,711 B1
(45) Date of Patent: Jun. 12, 2001

(54) THERMAL PAPER WITH SECURITY FEATURES

(75) Inventor: Wendell B. Halbrook, Jr., Waynesville, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/429,073

(22) Filed: Oct. 29, 1999

(51) Int. Cl.[7] ..... B41M 5/30

(52) U.S. Cl. ..... 503/206; 427/511; 427/152; 428/29; 428/690

(58) Field of Search ..... 427/511, 152; 428/29, 690; 503/206

(56) References Cited

U.S. PATENT DOCUMENTS 6,060,426 * 5/2000 Tan et al. ..... 503/200

6,165,937 * 12/2000 Puckett et al. ..... 503/201

* cited by examiner

*Primary Examiner*—Bruce H. Hess

(74) *Attorney, Agent, or Firm*—Millen White Zelano & Branigan PC

(57) ABSTRACT

A thermal paper with an image derived from a U.V., visible light or electron beam curable security ink has more than one means of security. Water repelling properties of the ink are a first security. A variable light absorbing and/or transmitting pigment or dye in the ink, pseudo-water mark or both, provide one or more additional security measures. Methods of preparing the thermal paper comprise printing the security ink on thermal paper on the surface opposite the thermosensitive coating and exposing the print to a U.V., visible light or electron beam radiation.

20 Claims, 2 Drawing Sheets

THERMAL PAPER WITH SECURITY FEATURES

FIELD OF THE INVENTION

The present invention relates to security inks used to thwart counterfeiting of printed commercial documents such as sales transaction records and receipts. More particularly, the invention relates to the use of security features on thermosensitive recording materials such as thermal paper.

BACKGROUND OF THE INVENTION

Many different means of security are available to prevent duplication of printed commercial documents such as special papers (water marked paper) and special inks (fluorescent inks and other optically variable inks) which form latent images or images that change color.

The use of latent images as a security measure is well known. To be useful as a security measure, latent images must be well camouflaged but readily and easily viewable to the user, preferably by a simple procedure. An example of such a latent image is described in U.S. Pat. No. 5,468,581, which is formed when printing documents using an intaglio process. The latent image is overprinted on the visible image such that the latent image is visible when the document is tilted and viewed at an angle. The latent image is caused by the variation of the slight shadow from the raised ink pattern formed by the intaglio process or other printing method which produces raised ink patterns.

Optically variable inks have been used to provide latent images and images which change color when exposed to a light source other than ambient light. These optically variable inks allow for non-destructive testing of the security feature allowing the printing of such inks to be monitored. Such optically variable inks typically contain a fluorescent compound or photochromic compound which responds to infrared or ultraviolet light. An example of an aqueous printing ink for jet printing which fluoresces under ultraviolet radiation is described in U.S. Pat. No. 4,153,593. The dyes described in this reference are water soluble and include fluorescein, eosine dyes and Rhodamine dyes.

Representative disclosures of other inks include U.S. Pat. No. 4,328,332, issued to Hayes et al. on May 4, 1982, and U.S. Pat. No. 4,150,997, issued to Hayes on Apr. 24, 1979. Kaule et al., U.S. Pat. Nos. 4,452,843 and 4,598,205, disclose rare earth metal luminophores which absorb in the visible region and optionally the near-infrared region and can be excited in substantial portions of the visible or near IR-region. Yoshinaga et al., U.S. Pat. No. 5,503,904, disclose recording media with an invisible identification mark composed of regions of high reflectance and low reflectance in the near infrared region. Near infrared coloring materials are said to comprise xanthene, oxazine, thiazine, polymethine and stryl compounds.

While the use of fluorescent inks and dyes has been effective and versatile, with the advent of today's personal computers and color copiers, conventional security measures such as these have been overcome, particularly where records are only casually inspected, such as sales receipts and transaction records. Therefore, it is desirable to provide additional security measures to supplement the fluorescent pigments and dyes.

Adding additional security measures is complicated by many factors. One is that there are many types of printing inks with compositions adapted to be employed in particular printing operations. For example, the inks for ink jet printers often must be conductive, have viscosity values within a certain range and contain no large particulate matter (below 5 $\mu$m) and the ink should not dry within the ink jet over short periods of time. Jet printing processes are described in Report No. 1722-1 of the Stanford University Electronic Research Laboratory dated March 1964, entitled "High Frequency of Oscillography with Electrostatically Deflected Ink Jets", and U.S. Pat. Nos. 3,596,275, 4,269,627, 4,153,593, 4,328,332, and 4,150,997. Special ink formulations are often employed in relief printing, offset printing, intaglio printing, lithography and silk screening.

Another factor which complicates adding a security measure to a security ink is that water-based inks are preferred to minimize the impact on the environment and avoid flammable vapors during use. This limits the components that can be added to the security ink.

An additional factor which complicates adding a security measure to a security ink is that it is difficult to complement the performance of fluorescent and photochromic pigments and dyes within optically variable inks without interfering with their performance. Parameters such as these place limitations on the additives or other components which can be used with security inks, making it difficult to provide multiple security measures within a security ink.

The above factors must be considered for the inks to be printed on plain paper. Where the security features are desired for thermal paper, the ink has additional requirements due to the special thermosensitive coatings thereon which generate images when activated by heat. The inks must not pre-react the reactive components within the thermosensitive coating of the thermal paper to detract from the papers printing performance. Certain chemical factors can adversely affect and degrade the performance of the thermosensitive coating and should be avoided such as some organic solvents (ketones), plasticizers (polyethylene glycol type) amines (ammonia) and certain oils (soy oil).

Direct thermal paper is a thermosensitive recording material on which print or a design is obtained by the application of heat energy. Thermal paper comprises a base sheet and a coating, and like other coated papers, the coating is applied to give new properties to the base sheet. However, a major distinction in thermal paper from other coated papers is that special color forming chemicals and additives are present in the coatings such that when heat is applied by a thermal head, the color forming chemicals react to develop the desired print or image.

The most common type of thermal coating is the dye-developing type system. The three main color producing components in a dye developing-type thermal coating are colorless dye (color former), a bisphenol or an acidic material (color developer) and sensitizer. These solid materials are reduced to very small particles by grinding and incorporated into a coating formulation along with any optional additives such as pigments, binders and lubricants. This coating formulation is then applied to the surface of paper or other support system using various types of coloring application systems and dried. Images are formed on the coated surfaces by the application of heat to melt and interact the three color producing materials.

To protect thermal paper from environmental conditions, and premature coloration from handling, a number of developments have been made. One is to produce a barrier or protection layer on top of the thermal coating (see U.S. Pat. Nos. 4,370,370; 4,388,362; 4,424,245; 4,444,819; 4,507,669; and 4,551,738). Another approach is to encapsulate the reactive components in microcapsules which rupture or are permeable when exposed to heat. See U.S. Pat. Nos. 4,682,194; 4,722,921; 4,740,495; 4,742,043; 4,783,493; and 4,942,150. A U.V. cured silicone acrylate/methacrylate protective coating for thermosensitive layers is described in U.S. Pat. No. 4,604,635. The use of a water soluble polyvinyl alcohol based intermediate coating as a protective layer on a thermal coating is described in EP 339,670. This intermediate coating may be cured by drying, exposure to U.V., or exposure to electron beam radiation and is overcoated with an electron beam radiation- cured layer. These protective measures will not always prevent premature coloration of thermal papers when exposed to a security ink, particularly when printed on the side opposite the thermosensitive coating of the thermal paper. In addition, these protective coatings are applied uniformly to the thermosensitive coating and not in selected regions as when printing so that any minor discoloration of the thermosensitive coating by these protective coatings may be uniform.

U.S. Pat. No. 5,883,043 describes a thermosensitive recording material with a latent image on the backside thereof that can function as a security feature. The latent image comprises a pigment or dye with variable light absorption properties and a water repelling agent that renders the image waterproof. These latent images are prepared by flexographic printing with the use of a security ink which preferably contains an aqueous based solvent.

SUMMARY OF THE INVENTION

It is an object of the present invention to provide a thermosensitive recording material, such as thermal papers used for cash register receipts and ATM receipts, with a latent image that provides more than one security feature to prevent counterfeiting.

It is another object of the present invention to provide a thermosensitive recording material, such as thermal paper, with a latent image comprised of a U.V., visible light or electron beam cured security ink that contains a photoinitiator and has a security measure for determining counterfeit documents which complements its appearance as a pseudo water mark and/or complements the use of optically variable pigments and dyes within the latent image.

It is a further object of the present invention to provide a method for applying a U.V., visible light or electron beam curable security ink with a photoinitiator to thermal paper to form a latent image without premature coloration of the thermal paper or degradation of the color formers.

Upon further study of the specification and appended claims, further objects and advantages of this invention will become apparent and further understood from the detailed description and claims which follow.

The above objects are achieved through thermosensitive recording materials such as thermal paper, with a thermal sensitive coating on one surface and a U.V., visible light or electron beam cured latent image which contains a photoinitiator printed on the surface opposite the thermal sensitive coating, the binders for which render the cured ink waterproof. As a second security feature, the latent image provides a pseudo water mark and/or also comprises a pigment or dye with variable light absorption and/or transmission properties.

The latent image comprises polymers of free-radical polymerizable monomers and oligomers which are free of ketone functional groups, primary or secondary amine functional groups and hydroxy functional groups. The monomer and oligomer components of the latent image do not react with the reactive components on the thermal paper, either before or after polymerization, such that the thermal paper will still generate color when exposed to heat. The latent image also comprises a photoinitiator, the amount of which depends on the functional groups on the photoinitiator. Where the initiator contains functional groups which react or solubilize the compounds of the thermosensitive layer, it is used in an amount less than 1 wt % based on the total ink formulation. This latent image provides at least two modes of security, one through the waterproof properties of the latent image, the other through either 1) variable light absorption/transmission properties of the latent image provided by dyes and/or pigments therein; 2) the appearance of the latent image as a pseudo water mark when transparent or a combination thereof.

In another aspect of the present invention, there is provided a method of preparing thermal paper having one thermosensitive surface and two or more, preferably three security features. This method comprises printing on the surface of a thermal paper which is opposite the thermosensitive coating, a security ink comprising a U.V., visible light or electron beam curable binder with a photoinitiator. The amount of binder is sufficient to form a waterproof image. The amount of photoinitiator is sufficiently low so as to minimize discoloration of the thermosensitive layer. The ink is applied by a lithographic, letter press, relief printing, offset printing or flexographic printing process which does not require temperatures above 50°–65° C. and is exposed to U.V., visible light or electron beam radiation following application to the thermal paper. The security ink either a) is free of colorants, as defined herein, so as to provide a transparent image, b) contains a pigment or dye with variable light absorption and/or transmission properties or c) is both free of colorants and contains a pigment or dye with variable light absorption and/or transmission properties.

The security inks used to form latent images on the thermal papers of present invention, cure by a free-radical curing mechanism, which is induced by exposure to U.V.light, visible light or electron beam radiation. The use of such security inks provides the following advantages:

1. All of the polymerization medium (ink) can be used to make the final image. Solvents, which can activate or solubilize the thermosensitive components in the thermosensitive coating, are not needed to provide the viscosity necessary for application of the ink to the receiver sheet.
2. The polymerization typically has no volatile byproducts which can activate or solubilize the thermosensitive components in the thermosensitive coating.

The thermal papers of the present invention have a base sheet or layer with one surface coated with a thermosensitive coating. Preferably, the base sheet is surface coated with a conventional base coating followed by the thermosensitive coating. The base coating is typically comprised of inert clays and provides a smooth surface for the thermosensitive coating. This thermosensitive coating is preferably of the dye-developing type. Particularly suitable dye developer systems are those wherein the reactive dyes are colorless or white-colored which become dark colored when melted and exposed to a color developer. Such dyes are typically basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. One skilled in the art can readily determine the melting point necessary for a desired application and select a dye and developer accordingly, or select a conventional thermal paper with a thermosensitive coating on one side. A well known dye is that identified as ODB-II with the sensitizer M-terphenyl. A preferred color developer is bisphenol A.

Color formers suitable for use in the coating formulations in thermosensitive recording materials of this invention are leuco dyes. Leuco dyes are colorless or light colored basic substances, which become colored when oxidized by acidic substances. Examples of leuco dyes that can be used herein are described as follows:

a) Leuco bases of triphenylmethane dyes represented by formula I in column 4 of U.S. Pat. No. 5,883,043 specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phthalide.

b) Leuco bases of fluoran dyes represented by formula II at column 5 of U.S. Pat. No. 5,883,043. Some examples are: 3-cyclohexylamino-6-chlorofluoran, 3-(N-N-diethylamino)-5-methyl-7-(N,N-Dibenzylamino) fluoran, 3-dimethylamino-5,7-dimethylfluoran and 3-diethylamino-7-methylfluoran. Other suitable fluoran dyes include: 3-diethylamino-6-methyl-7-chlorofluoran, 3-pyrrolidino-6-methyl-7-anilinofluoran, and 2-[3,6-bis(diethylamino)-9-(0-chloroanilino)xanthybenzoic acid lactam].

c) Lactone compounds represented by formula III at column 5 of U.S. Pat. No. 5,883,043. Specific examples are: 3-(2'-hydroxy-4'-dimethylaminophenyl)-3-(2'[-methoxy-5'-chlorophenyl)phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermal sensitive recording materials of this invention are phenol compounds, organic acids or metal salts thereof and hydroxybenzoic acid esters.

Preferred color developers are phenol compounds and organic acids which melt at about 50° C. to 250° C. and are sparingly soluble in water. Examples of phenol compounds include 4,4'-isopropylene-diphenol (bisphenol A), p-tert-butylphenol, 2,4-dinitrophenol, 3,4-dichlorophenol, p-phenylphenol, 4,4-cyclohexylidenediphenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel. Some of the color developers are 2,2,-bis(4'-hydroxyphenyl)propane (Bisphenol-A), p-phenylphenol, 2,2-bis(4'-hydroxyphenyl)-n-heptane and 4,4'-cyclohexylidene phenol.

Sensitizers or thermosensitivity promoter agents are used in the coating formulation and thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction to take place with ease at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

The thermosensitive coating compositions can be applied to any conventional base sheet suitable for use in thermal paper. The base sheet must not contain any reactive elements which would prematurely color the thermosensitive coating. The thermosensitive coating can vary in composition, as is conventionally known in the art, including the encapsulation of components therein and the use of protective layers thereon to prevent premature coloration during handling. Such thermosensitive coatings can also be applied by conventional methods using conventional equipment.

Security inks used to form latent images on the thermal papers of present invention and used in the methods of the present invention comprise free-radical polymerizable monomers and oligomers which are free of ketone functional groups, primary or secondary amine functional groups and hydroxy functional groups. The free-radical cure can be induced by exposure to U.V. light, visible light or electron beam radiation. A photoinitiator is included in the security ink and becomes part of the latent image. The photoinitiator is not needed where the free radical cure is initiated by exposure to electron beam radiation and so can be used at very low levels of less than 0.1 wt %, based on the total weight of the security ink.

The monomers and oligomers are selected so as not to pre-react the thermosensitive components of the thermal paper. To avoid pre-reaction of the these components, the monomers and oligomers do not have ketone functional groups, primary or secondary amine functional groups or hydroxy functional groups. Monomers and oligomers with such functional groups can degrade the performance of a thermosensitive coating by either reacting with the active components of the thermosensitive coating or solubilizing the ingredients therein.

Where a photoinitiator is used, it must be selected so as to avoid degradation of the thermosensitive coatings or it must be used at levels below 1 wt %, based on the weight of the total security ink, such that any degradation of the thermosensitive coating goes unnoticed. Common photoinitiators such as acetophenone, trichloroacetophenone, dialkoxyacetophenone and benzophenone have ketone functional groups that can cause degradation of the thermosensitive layer. Similarly, ketone/amine compounds such as 4,4-bisdiethylaminobenzophenone and 4,4-bisdimethylaminobenzophenone contain ketone functional groups and benzoin compounds such as benzoin and methylbenzoin, can contain hydroxy groups. Photoinitiators without active ketone, amine or hydroxy functional groups such as benzoin acetate, benzoin ethyl ethers, benzoin butyl ethers, benzoin methyl ethers, benzoin ketals such as benzoin dimethylketal can be used at levels above 1 wt %, as can aryldiazonium salts, diaryliodonium salts, triarylselenonium salts, dialkylphenacylsulphonium salt, aryloxydiarylsulphoxonium salt, aryloxydiarylsulphoxonium salts, dialylphenacylsulphonium salts, iron arene complexes, nitrobenzyl triarylsilyl ethers, triarylsilyl peroxides, acylsilanes, thioxanthane, ferrocene and xanthone photoinitiators.

In addition to maintaining the thermosensitive components unreacted, the monomers and oligomers employed must also provide a security ink with a viscosity suitable for lithographic printing and letter press printing which is below 500 cps at 25° C., preferably within the range of about 5 to 100 cps at 25° C. and most preferably 12–25 cps at 25° C. The monomers and oligomers are either liquid at ambient temperature or are low melting solids (50° C. or below). Inkometer values for the security ink preferably fall in the range of 12–18, as determined at 1200 rpm. Where the photopolymerizable monomers have a viscosity much higher than 50 cps at 25° C., they are diluted with either low viscosity coreactants or a low viscosity plasticizer which does not contain hydroxy groups.

Oligomers suitable for use in the security ink formulations include acrylates, polyurethanes, polyethers such as polyvinyl ether, unsaturated polyesters and epoxies. Of these oligomers, acrylate oligomers are preferred including epoxy acrylates, polyester acrylates, urethane acrylates, vinyloxyethyl acrylates, dicyclopentadiene acrylates and silicone acrylates.

Free radical polymerizable monomers which are suitable include multifunctional acrylic acid esters such as ethylene glycol diacrylate, triethylene glycol diacrylate, propylene glycol diacrylate, tripropylene glycol diacrylate (TPGPA), 1,6-hexanediol diacrylate, trimethylolpropane triacrylate, bisphenol A-diglycidyl ether diacrylate, pentaerythritol triacrylate, pentaerythritol diacrylate, neopentyl glycol diacrylate, sorbitol diacrylate, dipentaerythritol diacrylate, dipentaerythritol triacrylate, dipentaerythritol tetracrylate, dipentaerythritol penta acrylate and dipentaerythritol hexaacrylate. Other suitable polyfunctional monomers include polyallyl monomers such as diallylphthalate and tetraallyloxyethane, and polyvinyl monomers such as divinyladipate, butane divinylether and divinyl benzene. Monomers and oligomers with two or more reactive groups are used to increase crosslinking.

Monofunctional monomers are suitable including esters of acrylic acid, methacrylic acid and itaconic acid. Other suitable monofunctional monomers include monofunctional vinyl compounds such as styrene, substituted styrene, vinyl acetate, epoxies and vinyl ethers. Also suitable are derivatives of polyvinyl alcohols such as acetoacetylated polyvinyl alcohols, carboxy modified polyvinyl alcohols, reaction products of polyvinyl alcohol and polycarboxylic acids such as fumeric acid, trimelitic anhydride and itaconic anhydride. These monomers do not contain reactive functional groups.

Specific examples of suitable epoxy monomers and oligomers are disclosed in U.S. Pat. No. 5,437,964; in "Ring-Opening Polymerizations", Vol. 2, by Frisch and Reegan, Marcel Dekker, Inc. (1969); in "Hand-book of Epoxy Resins" by Lee and Nevill, McGraw Hill Book Company, New York (1967) and in "Epoxy Resin Technology" by P. F. Bruins, John Wiley & Sons, New York (1968). Specific examples of suitable vinylether monomers and oligomers are disclosed in U.S. Pat. No. 4,950,696.

Mixtures of suitable monomers and oligomers may also be used.

The security ink used to prepare the thermosensitive recording media of the present invention is preferably of a viscosity that does not require the use of a solvent for application to the thermosensitive recording sheet. However, it may be desirable to add a small portion of an aqueous solution of less than 25 wt. %, based on total weight of the formulation, to reduce the viscosity where the monomer and oligomer are water soluble. Although not preferred, an organic solvent can be used to improve solubility of the monomer and oligomer. The amount of solvent is maintained below 1 wt. %, based on the weight of the total formulation.

The latent image on the thermosensitive recording media may generally be comprised of the following components:

1. free-radical polymerized monomers and oligomers which are free of functional groups that react with the compounds of the thermosensitive layer;
2. one or more free radical photoinitiators (in an amount less than 1 wt % where the photoinitiator has one or more functional groups that react or solubilize the compounds of the thermosensitive layer);
3. optionally, one or more pigments or dyes with variable light absorption/transmission properties;
4. optionally, one or more photosensitizers;
5. optionally, one or more colorants selected from pigments and dyes; and
6. optionally, an aqueous solution at less than 25 wt %, with or without an organic solvent (at less than 1 wt. %).

Suitable photoinitiators include those compounds which form free radicals upon exposure to UV and/or visible light sufficient to initiate polymerization of compounds. The photoinitiator used may be a single compound, a mixture of two or more active compounds or a combination of two or more different compounds, i.e., co-initiators which form part of a multi-component initiating system.

Where the photoinitiator does not react with the thermosensitive components of the thermosensitive layer, it is preferably used in an amount of from 0.01 to 10 wt. % within the security ink formulation, based on the total weight of the security ink formulation. Where the photoinitiator does react or solubilize the thermosensitive components of the thermosensitive layer, it is used in an amount of less 1 wt % within the security ink formulation, based on the total weight of the security ink formulation. When the amount of photoinitiator is too small, the cure is insufficient and where an excessive amount is used, rapid cure results in a decrease in molecular weight, reduced adhesion to the thermal paper and possible discoloration of the thermosensitive layer.

A photosensitizer may be used with the photoinitiator in amounts of from 0.01 to 10 wt. %, based on the total weight of the ink formulation. A photosensitizer absorbs energy and then transfers it to another molecule, usually the photoinitiator. The structure of the photosensitizer remains unchanged. Photosensitizers are often added to shift the light absorption characteristics of a system. An example of a photosensitizer is anthracene, which is used with the diphenyliodonium cation. Suitable examples include anthracene, perylene, phenothiazine, xanthone, and thioxanthone. A photopolymerization initiation assistant may also be used. This is an agent which is not activated itself by ultraviolet radiation but which, when used with a photopolymerization initiator, helps the initiator speedup the initiation of polymerization; thus, realizing a more efficient cure.

Suitable light sources for curing the monomers and oligomers used to form the latent image depend on the photoinitiator used. Those responsive to visible light can be cured by ambient light from conventional incandescent light bulbs or fluorescent light bulbs. Those photoinitiators responsive to the UV light can be activated by high pressure mercury lamps, xenon-lamps, arc lamps and gallium lamps. The use of electron beam equipment does not require the use of a photo initiator.

The security ink formulations may contain an optional coloring agent which is capable of being sensed visually, by optical means, by magnetic means, by electroconductive means or by photoelectric means. Such coloring agents are not necessary to provide a security feature and are not preferred for some applications, such as where the colors interfere with a pseudo watermark. The coloring agent is typically a dye or pigment including a variety of organic and inorganic coloring pigments and dyes. Examples include carbon blacks, and other pigments such as cadmium, primrose, chrome yellow, ultra marine blue, iron oxide, zinc oxide, titanium oxide, cobalt oxide, nickel oxide, etc. Other examples of coloring agents include those described in U.S. Pat. Nos. 3,663,278 and 4,923,749. The total amount of coloring agent is typically from about 0.01–10 wt. % of the total ink formulation.

Dispersing agents may optionally be used to help solubilize the pigment or dye in the ink formulation. Conventional fillers, defoaming agents, viscosity modifiers/flow adjusters, leveling agents or cob-webbing preventative agents may also be incorporated to improve the properties of the security inks used to form the latent image. Illustrative examples of flow adjusters are low molecular weight organopolysiloxanes such as methylpolysiloxanes which may be used in an amount of 0.01–10 wt. % based on weight of the total ink formulation. An illustrative example of a defoamer, i.e., surfactant, is Anti-Musal JIC, which may be used in an amount of 0.01–10 wt. %based on the weight of the total ink formulation. Illustrative examples of leveling agents are low molecular weight polysiloxane/polyether copolymers and modified organic polysiloxane, which may be used in an amount of 0.01–10 wt. % based on the weight of the total ink formulations.

Other suitable additives for the security ink used to form the latent image are those which modify viscosity, which provide wettability (butylcarbitol), and which prevent polymerization of the security inks by natural or ambient light before use.

Plasticizers which do not react with the thermosensitive compound may also be used to aid flexibility of the latent image formed and/or reduce the viscosity of the security ink used to form the latent images. Suitable plasticizers include adipic acid esters, phthalic acid esters and ricinoleate acid esters, citrates, epoxies, hydrocarbons and chlorinated hydrocarbons, which do not have functional groups which react with or solubilize the thermosensitive compound.

The above components can be mixed and dispersed uniformly by an appropriate means such as a simple impeller within a vessel or a roll mill to obtain the security ink used to form the latent image.

Water and organic solvents are avoided, even when compatible with the thermosensitive layer in that they need to be evaporated on the thermosensitive recording media which can cause some shrinkage of the cured image and reduced adhesion to the substrate.

The ink formulations that produce the latent image can comprise over 99% and as little as 50 wt. % photopolymerizable monomer and oligomer which cure to provide images of a highly crosslinked polymer which adhere well to various substrates such as coated and uncoated paper. The ink formulations can comprise low levels of photopolymerizable monomer (as little as 50 wt %) when the monomers are low in viscosity or when the monomers are diluted by a non-volatile carrier such as a plasticizer. Preferred levels will depend on the monomers used and their viscosity.

The latent images on the thermal papers and methods of the present invention provide more than one security measure. One security measure is the water proof properties of the latent image. Another security measure can be provided through the use of a pigment or dye with variable light absorption and/or transmission properties, referred to herein as "optically variable" pigments and dyes. These pigments or dyes need not absorb or transmit light under ambient indoor conditions, i.e., they are transparent or invisible to the naked human eye under such conditions but do absorb or transmit light when exposed to UV radiation. The pigments and dyes used are soluble, dispersible or emulsifiable in the monomer and/or oligomer within the security ink formulation. Suitable pigments and dyes include the fluorescent resins produced in U.S. Pat. No. 4,328,332 from trimellitic anhydrides and propylene glycol with a zinc acetate catalyst.

The NIRF compounds employed in the thermosensitive recording media and methods of the present invention provide a security measure that is responsive to wavelengths in the near infrared region of 650 nm to 2500 nm. Suitable NIRF pigments and dyes include those phthalocyanines, naphthalocyanines, squaraines which are covalently bonded to various halometals described in U.S. Pat. Nos. 5,292,855; 5,423,432; 5,336,714; 4,461,136; 5,397,819; 5,703,229; 5,614,088; 5,665,151 and 5,503,904. The NIRF compounds preferably are transparent or invisible to the naked human eye under ambient light and does not cause premature reaction of the thermosensitive layer. The NIRF compound must be shielded from ambient air to prevent reaction with oxygen such as by incorporating the compound in pigment particles, applying a protective coating on the layers formed with such compounds, or both.

The concentration of the NIRF compound within the security inks used to form the thermal papers of this invention can vary over wide limits. In general, an optical effect can be developed on most thermal papers with a NIRF compound present within the security inks in an amount as low as 0.01 ppm based on the total weight of solids (dry components). Preferably, the amount of NIRF compound within the ink used falls within the range of 0.1 ppm to 1000 ppm, based on dry components of the security ink.

Apparatus used to detect the presence of NIRF compounds include any apparatus capable of detecting fluorescence, i.e., photons emitted by dyes and pigments at wavelengths in the range of about 650 nm to 2,500 nm, such as photomultiplier tubes and silicon photodiodes. Filters may be used to restrict the wavelengths which impinge the detector. Devices which irradiate the NIRF compounds with near infra-red radiation include laser diodes, light-emitting diodes, solid state lasers, lasers, incandescent light sources and other light sources which emit radiation at a wavelength in the range of 670–2500 nm. Filters may be used to restrict the wavelengths which irradiate the NIRF compounds.

Photochromic compounds which change color when exposed to UV light can also be used. Suitable photochromic compounds include the spiro compounds of formula V disclosed by Takahashi et al. in U.S. Pat. No. 5,266,447. These include spiroxazine compounds, spiropyran compounds and thiopyran compounds of the formulae in columns 5–6 of U.S. Pat. No. 5,266,447. Other examples of suitable photochromic compounds include the benzopyran compounds disclosed by Kumar in U.S. Pat. No. 5,429,774, the benzothioxanthone oxides disclosed by Fischer et al. in U.S. Pat. No. 5,177,218, the dinitrated spiropyrans disclosed by Hibino et al. in U.S. Pat. No. 5,155,230, the naphthacenequinones disclosed by Fischer et al. in U.S. Pat. No. 5,206,395 and U.S. Pat. No. 5,407,885, the naphthopyran compounds disclosed by Knowles in U.S. Pat. No. 5,384,077, the spiro(indoline) naphthoxazine compounds disclosed by VanGemert in U.S. Pat. No. 5,405,958, the ring compounds disclosed by Tanaka et al. in U.S. Pat. No. 5,106,988 and the spiro-benzoxazine compounds disclosed by Rickwood et al. in U.S. Pat. No. 5,446,151. Mixtures of such compounds are preferred and are available commercially from sources such as Color Change Corp. of Schaumburg, Ill. and Xytronyx Inc. of San Diego, Calif.

The pigment or dye employed will depend on the end use intended for the thermosensitive recording materials produced. The concentration of the dye or pigment material within the security inks used in the thermal papers and methods of this invention can vary over wide limits. In general, an optical effect can be developed on most thermal papers with a fluorescent dye or photochromic pigment component present in an amount which ranges from 2–50 wt. % and preferably in an amount within the range of 10 to 50 wt. %, based on dry components of the ink used.

For the water repelling properties of the latent image to provide a means of security for the thermal paper obtained the latent image must be waterproof, preferably with a surface tension less than 35 dynes, preferably between 20–30 dynes. Water has a surface tension of 70 dynes. When waterproof, the latent image will surface when wet with water or other aqueous solution. The latent image will not absorb water, forming beads thereon, and due to the distinct surface tension of the surrounding substrates (about 50–60 dynes), the application of water will render the latent image visible. A convenient method for exposing the image is to pass a water soluble ink such as in a felt marker over the image.

Water repelling properties are provided by the U.V., visible light or electron beam cured polymers, but water repelling agents may be used to enhance these properties. Suitable agents which will render the dry security ink waterproof include silicone resins. Suitable silicone resins include polydimethylsiloxanes such as those available from General Electric Company and Dow Corning Incorporation. Suitable examples include those polydimethylsiloxanes under the trade names "SE30" and "VISC-100M" provided by General Electric Company and Silastic 4-2901 and Silastic 4-2903 provided by Dow Corning Corporation. The amount employed preferably ranges from about 0.5–10 wt. % based on the weight of dry components and most preferably ranges from 1–5 wt. %. The water repelling agent should provide a dried latent image with a surface tension less than 35 dynes, preferably from 20–30 dynes. This will cause sufficient differentiation with the substrate, which typically has a surface tension of 50–60 dynes to reveal the image once wetted with water or other aqueous mixture.

In certain embodiments, the latent image will also provide a pseudo-water mark on the paper when the ink is dried on the substrate. This color may be generated by the cured resins, dyes, pigments or other components of the security ink.

A suitable additive is a soluble fluorescent brightener component that is used in combination with the fluorescent dye materials. The brightener typically enhances the fluorescence available from the same concentration of dye. Fluorescence can be increased by as much as five times the original value with the use of a fluorescent brightener. Care should be exercised to avoid the use of a brightener having an absorption curve which interferes with the fluorescence of the fluorescent material. Examples of brighteners include Calcofluor ABT by Cyanamid, Calcofluor A2RT by Cyanamid, Blancophor SV by GAF, Tinopal GS by Geigy, Leucophon BSW by Sandoz, Paper White SP by DuPont and Paper White BP by DuPont.

As discussed above, the security inks used to prepare the latent image on thermal papers of this invention may optionally comprise an aqueous based carrier for the dye or pigment. The aqueous based carrier comprises an aqueous solution with or without a small proportion of a water soluble organic solvent. The amount of aqueous based carrier can vary from 0 to 25 wt. % based on the total weight of the ink formulation. These security inks are dried with the curing of the monomers and oligomers therein on the thermal paper.

The thermal papers which contain a security ink can be prepared by the methods of this invention, wherein a security ink as described above is applied to the side of a thermal paper opposite the thermosensitive layer by either relief printing, offset printing, flexography, lithography, letter press or silk screening at a temperature of less than 65° C. A preferred printing method is lithographic printing. Once the security ink is applied to the thermal paper, it is exposed to U.V., visible light or electron beam radiation to cure the monomers and oligomers therein, preferably at ambient temperature.

To provide the security ink, a mixture of the curable oligomer and monomer is prepared and any pigments, additives or solvents are added to this mixture and ground, where a photoinitiator is added, it is preferably added last.

Without further elaboration, it is believed that one skilled in the art can, using the preceding description, utilize the present invention to its fullest extent. The entire disclosure of all applications, patents, publications, cited above and below, are herein incorporated by reference.

EXAMPLES

Thermal Paper

A mill roll of commercial thermal paper having a thermosensitive coating on only one side thereof, is reduced to a roll 3.15" wide, 3–9" in diameter. The thermal paper roll is reduced for use in direct thermal printers. This thermal paper has a conventional base coat (about 40% solids) comprising conventional components such as clays/binders applied to the base sheet. The active coat comprises conventional active coating components for the dye, coreactant, sensitizer and stabilizer, such as a ODB-II dye and a bisphenol coreactant. The ODB-2 dye is ground for 2 hours separately from the coreactant and sensitizer in order to avoid premature reaction during the grinding process.

The dye grind (38% solids) and bisphenol grind (41% solids) are typically aged for a minimum of 12 hours, then mixed together for a minimum of 0.5 hr. before use in the coat applicator on the base sheet. The base coat and active coat are applied to the base sheet in sequence.

Security Ink

A security ink comprising the following components is prepared within an attritor:

i) 5 to 30 wt. % UV fluorescent pigment from BASF, ii) 0–25 wt. % water, iii) 30 to 70 wt. % U.V. curable monomer, iv) 5 to 60 wt. % U.V. curable oligomer, and v) 0.5–5 wt % photoinitiator, all based on total solids.

The viscosity of the ink falls within the image of 20–24 with a #2 Zahn cup.

The security ink is printed on the roll of thermal paper described above using a lithographic press and is exposed to ultraviolet light from a non-doped Mercury Arc lamp at an intensity of 300 watts/in for 3 seconds, while traveling 15–20 ft./min. in a U.V. cabinet from U.V. Process Supply Inc., 4001 North Ravenswood Avenue, Chicago, Ill. 60613. The the image printed is the logo for the NCR Corporation.

A thermal paper with a latent image is produced, and is represented in FIG. 1. The thermal paper is tested for use in direct thermal printing and provides a suitable print density from conventional thermal printers operating with a pulse time of at least 0.38 milliseconds.

Security Test

Imaged substrate 5 produced in Example 1 is tested for luminescence and for waterproofness. FIG. 2 shows imaged substrate 5 illuminated with a UV light from a mercury arc lamp operating at 365 nm to fully reveal latent image 10 and FIG. 3 shows substrate 5 with the latent image 10 passed over with a highlight pen (pink) to form overwriting 15 and reveal the image by the differentiation in water absorption between the latent image 10 and the substrate. FIG. 4 shows substrate 5 at an angle less than 45° from the surface thereof to reveal a pseudo-watermark.

BRIEF DESCRIPTION OF THE DRAWINGS

Various other features and advantages of the present invention will be more fully appreciated as the same becomes better understood when considered in conjunction with the accompanying drawings, in which like reference characters designate the same or similar parts throughout the several views, and wherein.

Figure 1:
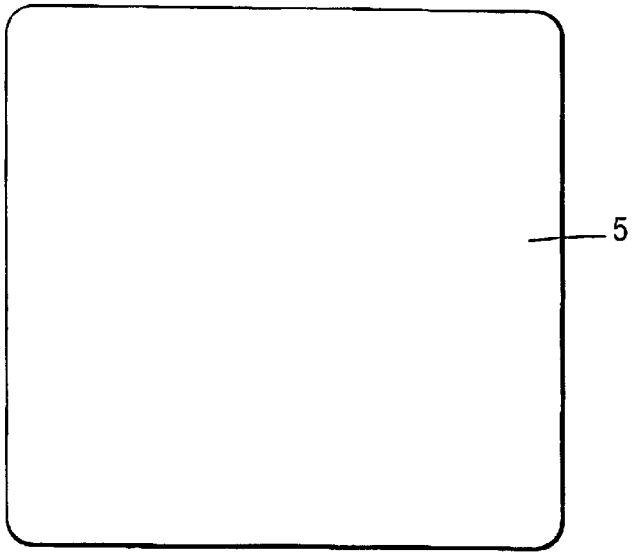
FIG. 1 illustrates thermal paper of the present invention, at a viewing angle of 90° from the surface, having a latent image printed thereon, which is illuminated by a 60 watt incandescent light bulb.
Figure 2:
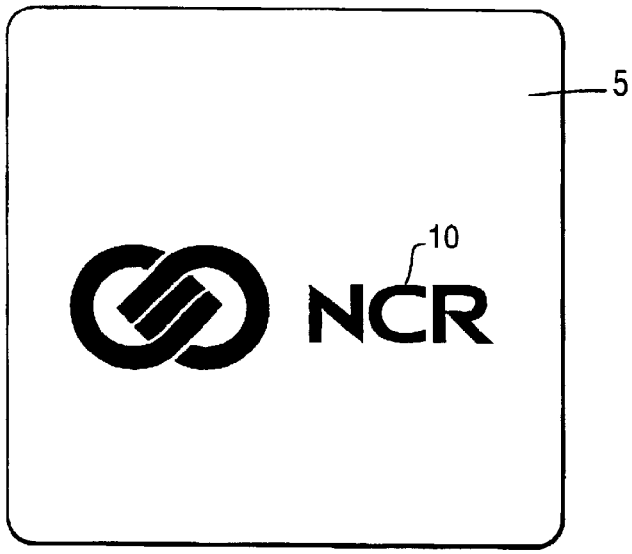
FIG. 2 illustrates a thermal paper as in FIG. 1, at a viewing angle of 90° from the surface which is illuminated under ultraviolet light.
Figure 3:
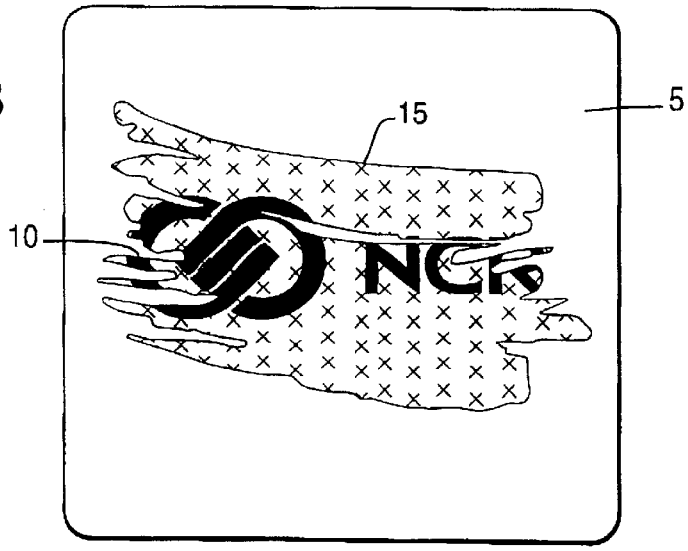
FIG. 3 illustrates a thermal paper of FIG. 1 at a viewing angle of 90° from the surface which is overwritten with a water soluble ink and illuminated with a 60 watt incandescent light bulb.
Figure 4:
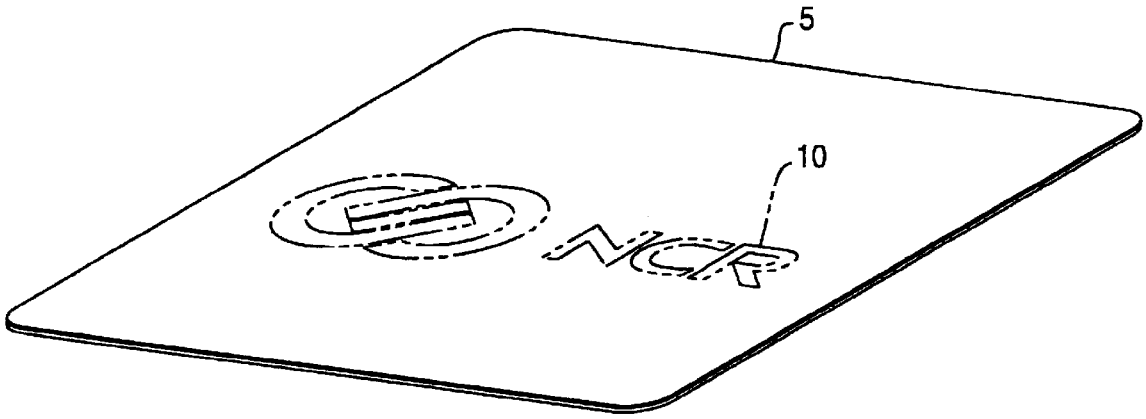
FIG. 4 illustrates a thermal paper as in FIG. 1 at a viewing angle of 30° from the surface and illuminated with a 60 watt incandescent light bulb.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermosensitive recording material comprising

A) a base sheet,

B) a thermosensitive coating comprising thermosensitive components on only one surface of said base sheet and C) a latent image on the surface of the base sheet, opposite the thermosensitive coating, wherein said latent image comprises a) a polymer binder obtained by a U.V., visible light or electron beam initiated free radical cure of at least one monomer and at least one oligomer within a security ink which has a viscosity less than 500 cps at 25° C. and comprises 0–25 wt % of an aqueous based solvent with from 0–1 wt % organic solvent, wherein said monomers and oligomers are free of ketone functional groups, primary or secondary amine functional groups and hydroxy functional groups;

b) at least one photoinitiator in an amount either less than 10 wt %, based on the weight of the security ink, where said photoinitiator is free of ketone functional groups, primary or secondary amine functional groups and hydroxy functional groups or less than 1 wt %, based on the weight of the security ink, where said photoinitiator contains ketone functional groups, primary or secondary amine functional groups or hydroxy functional groups which degrade the thermosensitive components of the thermosensitive coating;

wherein said latent image is waterproof and either i) forms a pseudo watermark, ii) additionally comprises a pigment or dye with variable light absorption and/or transmission properties, or iii) provides a combination of i) and ii).

2. A thermosensitive recording material as in claim 1 which comprises a thermal paper.

3. A thermal paper as in claim 2, wherein the latent image contains at least one pigment or dye with variable light absorption and/or transmission properties that is selected from the group consisting of fluorescent pigments and dyes, photochromic pigments and dyes, and NIRF compounds and said latent image is visible to the naked human eye when exposed to ultraviolet light, light in the infrared region, or light in the near-infrared region.

4. A thermal paper as in claim 2, wherein the latent image is transparent to the naked human eye and forms a pseudo water mark at a viewing angle of less than 90° from the plane or the surface for said thermal paper when under illumination with a 60 watt incandescent light bulb, said latent image is also free of pigment or dye selected from the group consisting of fluorescent pigments and dyes, photochromic pigments and dyes, and NIRF compounds.

5. A thermal paper as in claim 2, wherein said latent image is transparent to the naked human eye and forms a pseudo water mark at a viewing angle of less than 90° from the plane of the surface for said thermal paper under illumination with a 60 watt incandescent light bulb, wherein said latent image also contains at least one pigment or dye with variable light absorption and/or transmission properties that is selected from the group consisting of fluorescent pigments and dyes, photochromic pigments and dyes, and NIRF compounds and is visible to the naked human eye when exposed to ultraviolet light, light in the infrared region, or light in the near-infrared region.

6. A thermal paper as in claim 2, wherein the dried waterproof ink has a surface tension less than 35 dynes.

7. A thermal paper as in claim 2, wherein the security ink has less than 0.1 wt % photoinitiator, based on the total weight of the security ink.

8. A thermal paper as in claim 2, wherein the security ink has an amount of photoinitiator of from 0.01 to 10 wt. %, based on the total weight of the security ink formulation.

9. A thermal paper as in claim 2, wherein

A) the U.V., visible light or electron beam curable oligomers are selected from the group consisting of acrylates, polyurethanes, polyvinyl ethers, unsaturated polyesters and epoxies; and B) the U.V., visible light or electron beam curable monomers are selected from the group consisting of polyfunctional acrylates, polyallyl monomers and polyvinyl monomers, esters of acrylic acid, esters of methacrylic acid, esters of itaconic acid, styrene, substituted styrene, vinyl acetate, vinyl ethers, acetoacetylated polyvinyl alcohols, carboxy modified polyvinyl alcohols, the reaction product of polyvinyl alcohol and fumeric acid, the reaction product of polyvinyl alcohol and trimelitic anhydride and the reaction product of polyvinyl alcohol and itaconic anhydride.

10. A thermal paper as in claim 2, wherein the photoinitiator is selected from the group consisting of acetophenone, trichloroacetophenone, dialkoxyacetophenone, benzophenone, 4,4-bisdiethylaminobenzophenone, 4,4-bisdimethylaminobenzophenone, benzoin, methylbenzoin, benzoin acetate, benzoin ethyl ethers, benzoin butyl ethers, benzoin methyl ethers, benzoin ketals, benzoin dimethylketal, thioxanthane, ferrocene and xanthone.

11. A thermal paper as in claim 2, wherein the photoinitiator is selected from the group consisting of aryldiazonium salts, diaryliodonium salts, triarylsulphonium salts, triarylselenonium salts, dialkylphenacylsulphonium salts, aryloxydiarylsulphoxonium salts, dialylphenacylsulphoxonium salts, iron arene complexes, nitrobenzyl triarylsilyl ethers, triarylsilyl peroxides and acylsilanes.

12. A method of preparing a thermal paper having more than one security feature wherein said thermal paper comprises a base sheet, a thermosensitive coating comprising thermosensitive components on only one surface of said base sheet, and wherein said method comprises, A) printing a security ink on the side of the base sheet of said thermal transfer paper which is uncoated with a thermosensitive coating, wherein said security ink is printed by a flexographic, letterpress, relief printing, lithographic printing or offset printing technique at a temperature less than 65° C., said security ink comprising a) at least one U.V., visible light or electron beam curable monomer and at least one U.V., visible light or electron beam curable oligomer, wherein the monomers and oligomers are free of ketone functional groups, primary or secondary amine functional groups and hydroxy functional groups and b) a photoinitiator in an amount either less than 10 wt %, based on the weight of the security ink, where said photoinitiator is free of ketone functional groups, primary or secondary amine functional groups and hydroxy functional groups or less than 1 wt %, based on the weight of the security ink, where said photoinitiator contains ketone functional groups, primary or secondary amine functional groups or hydroxy functional groups which are reactive with or solubilize the thermosensitive components of the thermosensitive coating; and c) 0–25 wt % of an aqueous based solvent with from 0–1 wt % organic solvent, based on the weight of the security ink; and B) exposing said printed security ink to U.V. radiation, visible light radiation or electron beam radiation to cure said security ink.

13. A method as in claim 12, wherein the security ink is printed by a lithographic printing method or letter press printing method.

14. A method as in claim 12, wherein any aqueous based solvent present in the security ink is evaporated prior to curing said security ink by exposure to U.V. radiation, visible light radiation or electron beam radiation.

15. A method as in claim 12, wherein the security ink composition contains no aqueous based solvent or organic solvent to evaporate.

16. A method as in claim 12, wherein the photoinitiator is selected from aryldiazonium salts, diaryliodonium salts, triarylsulphonium salts, triarylselenonium salts, dialkylphenacylsulphonium salts, aryloxydiarylsulphoxonium salts, dialylphenacylsulphoxonium salts, iron arene complexes, nitrobenzyl triarylsilyl ethers, triarylsilyl peroxides and acylsilanes.

17. A method as in claim 12, wherein the security ink has less than 0.1 wt % photoinitiator, based on the total weight of the security ink.

18. A method as in claim 12, wherein the security ink has less than 1 wt % photoinitiator, based on the total weight of the security ink.

19. A method as in claim 12, wherein

A) the U.V., visible light or electron beam curable oligomers are selected from the group consisting of acrylates, polyurethanes, polyvinyl ethers, unsaturated polyesters and epoxies; and B) the U.V., visible light or electron beam curable monomers are selected from the group consisting of polyfunctional acrylates, polyallyl monomers, polyvinyl monomers, esters of acrylic acid, esters of methacrylic acid, esters of itaconic acid, styrene, substituted styrene, vinyl acetate, vinyl ethers, acetoacetylated polyvinyl alcohols, carboxy modified polyvinyl alcohols, the reaction product of polyvinyl alcohol and fumeric acid, the reaction product of polyvinyl alcohol and trimelitic anhydride and the reaction product of polyvinyl alcohol and itaconic anhydride.

20. A method as in claim 12, wherein the photoinitiator is selected from the group consisting of acetophenone, trichloroacetophenone, dialkoxyacetophenone, benzophenone, 4,4-bisdiethylaminobenzophenone, 4,4-bisdimethylaminobenzophenone, benzoin, methylbenzoin, benzoin acetate, benzoin ethyl ethers, benzoin butyl ethers, benzoin methyl ethers, benzoin ketals, benzoin dimethylketal, thioxanthane, ferrocene and xanthone.

* * * * *